US008746823B2

(12) United States Patent
Kondo et al.

(10) Patent No.: US 8,746,823 B2
(45) Date of Patent: Jun. 10, 2014

(54) PRINTING DEVICE AND PRINTING METHOD

(75) Inventors: Takamitsu Kondo, Nagano (JP); Toru Takahashi, Nagano (JP); Hiroshi Wada, Nagano (JP); Toshio Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 13/405,955

(22) Filed: Feb. 27, 2012

(65) Prior Publication Data

US 2012/0223982 A1 Sep. 6, 2012

(30) Foreign Application Priority Data

Mar. 2, 2011 (JP) ..... 2011-045419

(51) Int. Cl.
*B41J 29/38* (2006.01)
*B41J 2/195* (2006.01)

(52) U.S. Cl.
USPC ..... 347/9; 347/16; 347/6; 347/7

(58) Field of Classification Search
USPC ..... 347/9, 6–7, 14, 16, 101–102
See application file for complete search history.

(56) References Cited

U.S. PATENT DOCUMENTS

| | | | | |
|---|---|---|---|---|
| 2004/0032473 | A1 | 2/2004 | Ishimoto et al. | |
| 2011/0032299 | A1* | 2/2011 | Mimura | 347/15 |
| 2011/0074857 | A1* | 3/2011 | Mitsuzawa | 347/16 |

FOREIGN PATENT DOCUMENTS

| | | | |
|---|---|---|---|
| CN | 1464841 | A | 12/2003 |
| JP | 2005-199563 | A | 7/2005 |
| JP | 2006-088529 | A | 4/2006 |

* cited by examiner

*Primary Examiner* — Jason Uhlenhake
(74) *Attorney, Agent, or Firm* — Global IP Counselors, LLP

(57) ABSTRACT

To reduce the tendency of glossiness to vary according to the ink ejection quantity, a printing device includes a color ink head for ejecting color ink to a medium, a clear ink head for ejecting transparent clear ink to the medium, and a controller for controlling ejection of the clear ink so that the clear ink is ejected to a region in which an ejection quantity of the color ink per unit area of the medium is less than a predetermined quantity, and the clear ink is not ejected to a region in which the ejection quantity of the color ink per unit area of the medium is greater than the predetermined quantity.

9 Claims, 12 Drawing Sheets

PRINTING DEVICE AND PRINTING METHOD

CROSS-REFERENCE TO RELATED APPLICATIONS

This application claims priority to Japanese Patent Application No. 2011-045419 filed on Mar. 2, 2011. The entire disclosures of Japanese Patent Application No. 2011-045419 is hereby incorporated herein by reference.

BACKGROUND

1. Technical Field

The present invention relates to a printing device and printing method.

2. Background Technology

Printing devices using ultraviolet-curing ink (referred to hereinafter as "UV ink") have been developed that cure the ink by emitting ultraviolet rays. Printing devices have also been developed which provide glossy printed matter by applying a coating of a transparent ink in printing using UV ink.

Patent Citation 1 describes an image recording system for providing matte printed matter and glossy printed matter by using two types of transparent ink.

Japanese Patent Application Publication No. 2006-88529 (Patent Citation 1) is an example of the related art.

SUMMARY

Problems to be Solved by the Invention

In image formation, the degree to which light is reflected by ink varies according to the deposited quantity of ink. For example, in the case that a large quantity of ink is deposited, adjacent deposits of ink integrate with each other due to surface tension, incident light is reflected at substantially the same angle, and a printed matter having a high degree of gloss is therefore provided. In the case that a small quantity of ink is deposited, the ink deposits solidify on the medium while still maintaining a hemispherical shape. Incident light is then diffusely reflected by the hemispherical ink deposits, and a printed matter having low degree of gloss is therefore provided. Differences in the degree of gloss thus occur according to the deposited quantity of ink, i.e., the level of the image. Differences in the degree of gloss on the same sheet of medium can lead to reduced print quality. There is a need to reduce the tendency of glossiness to vary according to the ink ejection quantity.

The invention was developed in view of the foregoing, and an advantage of the invention is to reduce the tendency of glossiness to vary according to the ink ejection quantity.

Means Used to Solve the Above-Mentioned Problems

The primary invention for achieving the abovementioned advantages is a printing device including:

a color ink head for ejecting color ink to a medium;

a clear ink head for ejecting transparent clear ink to the medium; and a controller for controlling ejection of the clear ink so that the clear ink is ejected to a region in which an ejection quantity of the color ink per unit area of the medium is less than a predetermined quantity, and the clear ink is not ejected to a region in which the ejection quantity of the color ink per unit area of the medium is greater than the predetermined quantity.

Other features of the invention will become apparent from the description of the present specification and accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
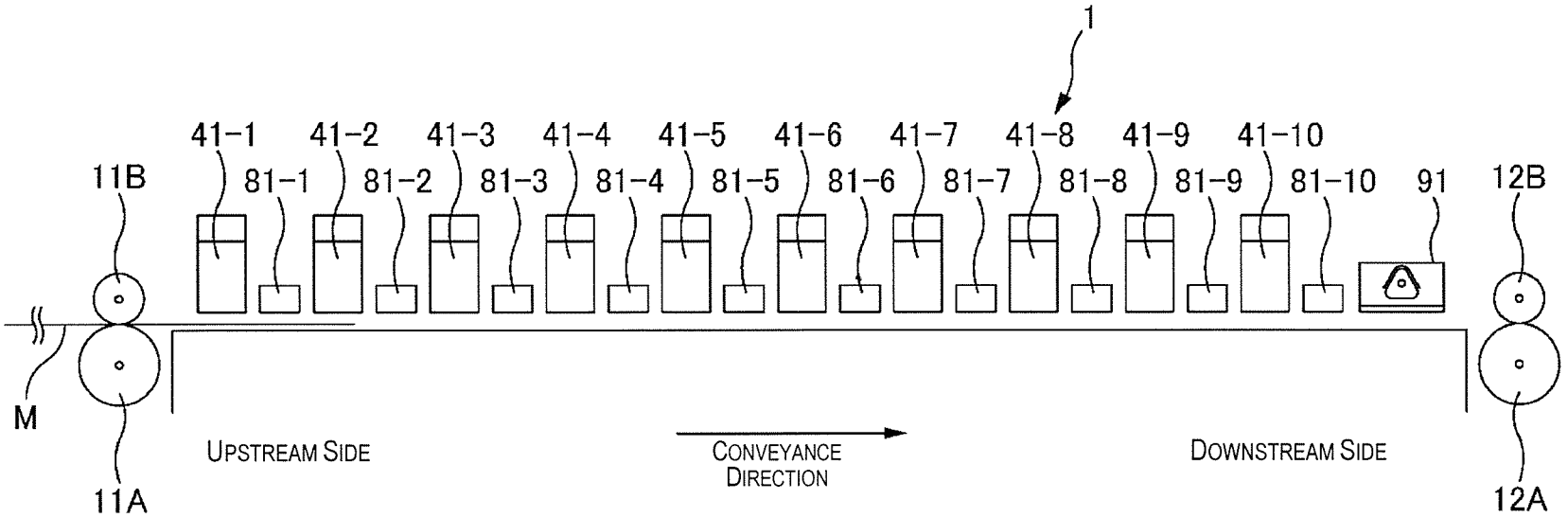
FIG. 1 is a rough side view showing the printer 1 according to a first embodiment.

At least the aspect described below will become apparent from the description of the present specification and accompanying drawings. Specifically, an aspect of the invention resides in a printing device including:

a color ink head for ejecting color ink to a medium;

a clear ink head for ejecting transparent clear ink to the medium; and a controller for controlling ejection of the clear ink so that the clear ink is ejected to a region in which an ejection quantity of the color ink per unit area of the medium is less than a predetermined quantity, and the clear ink is not ejected to a region in which the ejection quantity of the color ink per unit area of the medium is greater than the predetermined quantity.

Through this configuration, clear ink is ejected to a region in which there is little color ink, i.e., a low-level region, and since color ink or clear ink can be ejected to the entire surface of the medium, it is possible to reduce the tendency of glossiness to vary according to the ink ejection quantity.

Preferably, in this printing device, the color ink is a photo-curing color ink; the clear ink is a photo-curing clear ink; and a photo-irradiation device is further provided for radiating light to the medium to cure at least one of the photo-curing color ink and the photo-curing clear ink. Through this configuration, the curing timing of each ink can be adjusted to control the degree of gloss.

Preferably, the controller performs an ejection and curing operation for ejecting the photo-curing color ink and subsequently radiating the light to the medium to cure the photo-curing color ink; and when an image having a first degree of gloss is formed, the image is formed by a first number of ejection and curing operations, and when an image having a second degree of gloss lower than the first degree of gloss is formed, the image is formed by a second number of ejection and curing operations greater than the first number. In the case that an image is formed by a plurality of ejection and curing operations, the photo-curing ink ejected to the medium is cured each time the photo-curing ink is deposited. Curing thereby takes place before the photo-curing ink integrates with adjacent ink. Consequently, the probability of integration with adjacent ink decreases the greater the number of ejection and curing operations is performed, and diffused reflection of light by the ink fixed in a hemispherical shape is more likely to occur. Specifically, printed matter having a different degree of gloss can easily be provided by varying the number of ejection and curing operations.

Preferably, the controller radiates light to the medium after causing the photo-curing clear ink to be ejected so as to be adjacent to the photo-curing color ink in a case in which the ejection quantity of the photo-curing color ink per unit area of the medium is less than the predetermined quantity when an image having the first degree of gloss is formed; and the controller radiates the light after causing the photo-curing clear ink to be ejected so as not to be adjacent to the photo-curing color ink in a case in which the ejection quantity of the photo-curing color ink per unit area of the medium is less than the predetermined quantity when an image having the second degree of gloss is formed. It is sometimes the case that the degree of gloss is low only in a low-level region of a printed matter having the first degree of gloss (high degree of gloss (glossy)), but since the clear ink is ejected so as to be adjacent to the color ink, and both types of ink are cured by photo-irradiation after integrating, a printed matter can be provided in which low-level regions also have a high degree of gloss. Specifically, a printed matter can be provided in which differences in the degree of gloss are minimized for all levels. A printed matter having the second degree of gloss (low degree of gloss (matte)) sometimes has a high degree of gloss only in low-level regions, but since the clear ink is ejected so as not to be adjacent to the color ink, and the color ink is cured by photo-irradiation in the hemispherical state thereof on the medium, a printed matter can be provided in which light is reflected diffusely and low-level regions also have a low degree of gloss. Specifically, a printed matter can be provided in which differences in the degree of gloss are minimized for all levels.

Preferably, the photo-irradiation device includes at least a color ink partial-curing device and a clear ink partial-curing device; and during formation of an image having the second degree of gloss, the photo-curing color ink is partially cured by the color ink partial-curing device after the photo-curing color ink is ejected from the color ink head, and the photo-curing clear ink is partially cured by the clear ink partial-curing device after the photo-curing clear ink is ejected from the clear ink head. Through this configuration, a printed matter in which low-level regions also have a low degree of gloss can be provided in printing with the second degree of gloss. Specifically, a printed matter can be appropriately provided in which differences in the degree of gloss are minimized for all levels.

Preferably, the photo-irradiation device further includes a full-curing photo-irradiation device; and during formation of an image having the first degree of gloss, the photo-curing color ink is ejected from the color ink head, and the photo-curing clear ink is ejected from the clear ink head, after which the photo-curing color ink and the photo-curing clear ink are cured by the full-curing photo-irradiation device. Through this configuration, a printed matter in which low-level regions also have a high degree of gloss can be provided in printing at the first degree of gloss. Specifically, a printed matter can be appropriately provided in which differences in the degree of gloss are minimized for all levels.

The first number is preferably one. Through this configuration, an image having the highest degree of gloss can be formed in image formation at the first degree of gloss.

At least the aspect described below will become apparent from the description of the present specification and accompanying drawings. Specifically, an aspect of the invention resides in a printing method including the steps of:

calculating an ejection quantity of color ink for each predetermined unit area of a medium; and ejecting clear ink only to a region in which the ejection quantity of the color ink per the unit area in the medium is less than a predetermined quantity.

Through this configuration, clear ink is ejected to a region in which there is little color ink, i.e., a low-level region, and since color ink or clear ink can be ejected to the entire surface of the medium, it is possible to reduce the tendency of glossiness to vary according to the ink ejection quantity.

First Embodiment

A printer 1 in a first embodiment is capable of ejecting four color inks (yellow ink Y, magenta ink M, cyan ink C, and black ink K) and a transparent clear ink CL. The inks used in the first embodiment are UV inks (ultraviolet-curing inks).

Figure 2:
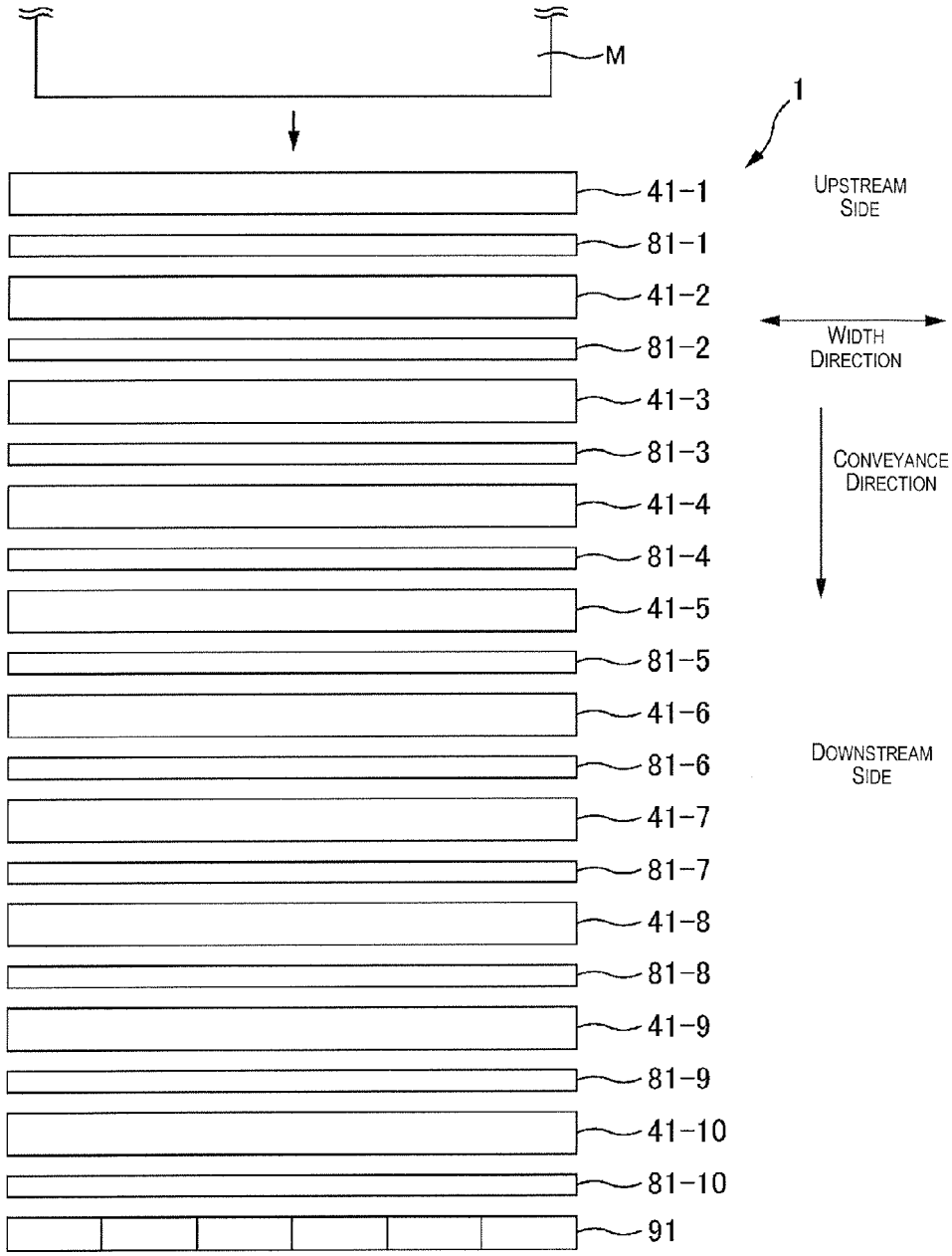
FIG. 2 is a rough top view showing the printer 1 according to the first embodiment.
Figure 3:
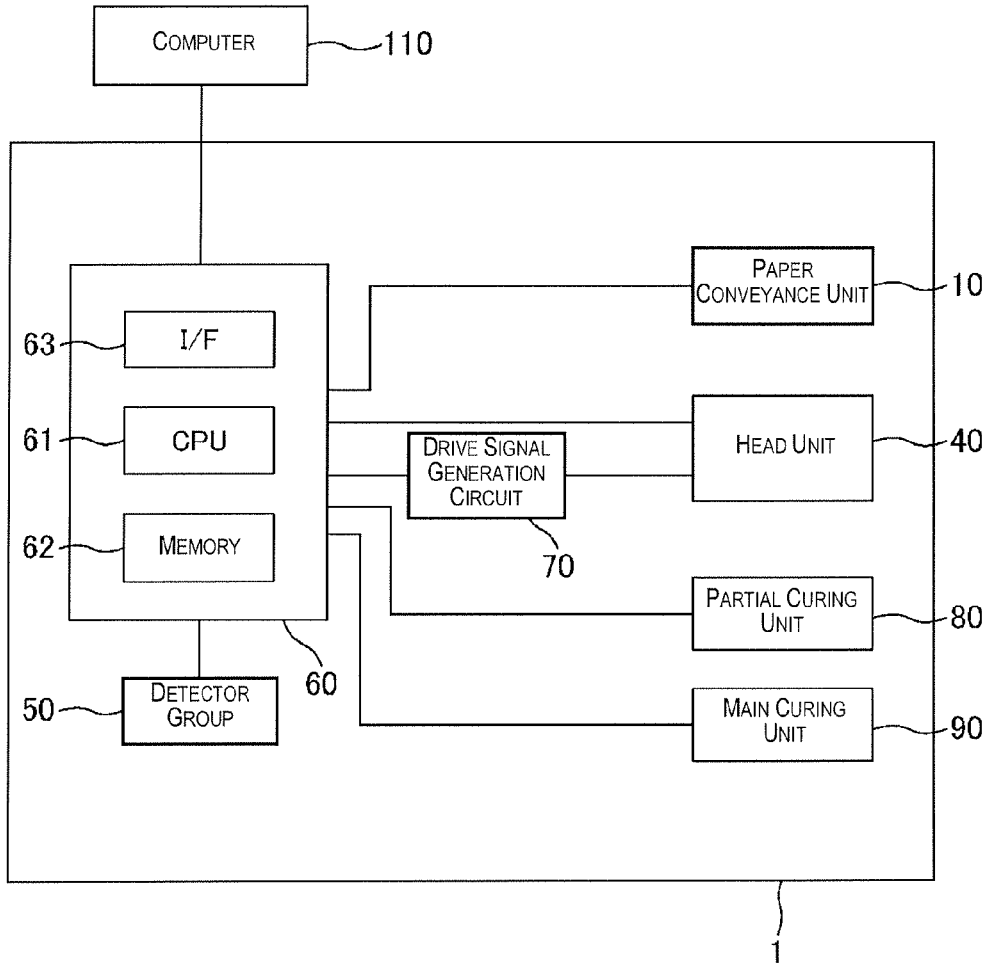
FIG. 3 is a block diagram showing the printer 1 according to the first embodiment.

FIG. 1 is a rough side view showing the printer 1 in the first embodiment. FIG. 2 is a rough top view showing the printer 1 in the first embodiment. FIG. 3 is a block diagram showing the printer 1 in the first embodiment. The configuration of the printer 1 will be described with reference to these drawings.

FIG. 3 shows the printer 1 and a computer 110. The printer 1 is provided with a paper conveyance unit 10, a head unit 40, a detector group 50, a controller 60, a drive signal generation circuit 70, a partial-curing unit 80, and a full-curing unit 90.

The paper conveyance unit 10 includes a conveyance roller 11A, a first presser roller 11B, a paper exit roller 12A, and a second presser roller 12B. The conveyance roller 11A and the paper exit roller 12A are connected to a motor not shown in the drawing, and the rotation of the motor is controlled by the controller 60. A medium is held between the conveyance roller 11A and the first presser roller 11B and thereby conveyed in the conveyance direction. The medium is also held between the conveyance roller 12A and the first presser roller 12B and thereby conveyed in the conveyance direction and discharged.

The head unit 40 includes a first yellow head unit 41-1 (corresponding to a first head), a second yellow head unit 41-2 (corresponding to a second head), a first magenta head unit 41-3, a second magenta head unit 41-4, a first cyan head unit 41-5, a second cyan head unit 41-6, a first black head unit 41-7, and a second black head unit 41-8. The head unit 40 also includes a first clear ink head unit 41-9 and a second clear ink head unit 41-10. The configuration of these head units is described hereinafter.

The detector group 50 includes various detectors for detecting information of each component of the printer 1 and sending the information to the controller 60.

The controller 60 is a control unit for controlling the printer 1. The controller 60 has a CPU 61, a memory 62, and an interface section 63. The CPU 61 is a computational processing device for controlling the printer as a whole. The memory 62 maintains a working area, an area for storing a program of the CPU 61, and other areas, and has a RAM, EEPROM, or other storage element. The CPU 61 controls each unit in accordance with a program stored in the memory 62. The interface section 63 transmits and receives data between the printer 1 and the computer 110, which is an external device.

The drive signal generation circuit 70 generates drive signals which are applied to piezo elements or other drive elements included in the head described hereinafter to cause ink droplets to be discharged. The drive signal generation circuit 70 includes a DAC not shown in the drawing. Analog voltage signals are generated on the basis of digital data that relate to the waveform of a drive signal sent from the controller 60. The drive signal generation circuit 70 also includes an amplifier circuit not shown in the drawing, and amplifies the power of the generated voltage signal to generate a drive signal.

The partial-curing unit 80 radiates ultraviolet rays to ultraviolet-curing ink deposited on the medium and semi-cures ("partial curing" is referred to hereinafter as "pinning") the deposited ink. Specifically, the viscosity at the surface of the ink deposited on the medium is increased to suppress movement of the ink. By thus increasing the viscosity at the surface of the deposited ink, ink deposits can be made less prone to move together when other ink is deposited in the vicinity of the deposited ink. Specifically, integration of ink deposits can be suppressed.

The partial-curing unit 80 includes ten sets of LED assembly units 81-1 through 81-10. These LED assembly units 81-1 through 81-10 partially cure the ink ejected on the upstream sides thereof in the conveyance direction of the medium M. The configuration of the LED assembly units 81 is described hereinafter.

The full-curing unit 90 includes a full-curing light source unit 91 (corresponding to the full-curing photo-irradiation device). The full-curing light source unit 91 is disposed at the downstream end in the conveyance direction, as shown in FIG. 2. Light including ultraviolet rays is radiated to the medium M, and the each ink deposited on the medium M is fully cured. For full curing, a metal halide lamp is used as the light source of the full-curing light source unit 91 in the present embodiment.

Figure 4A:
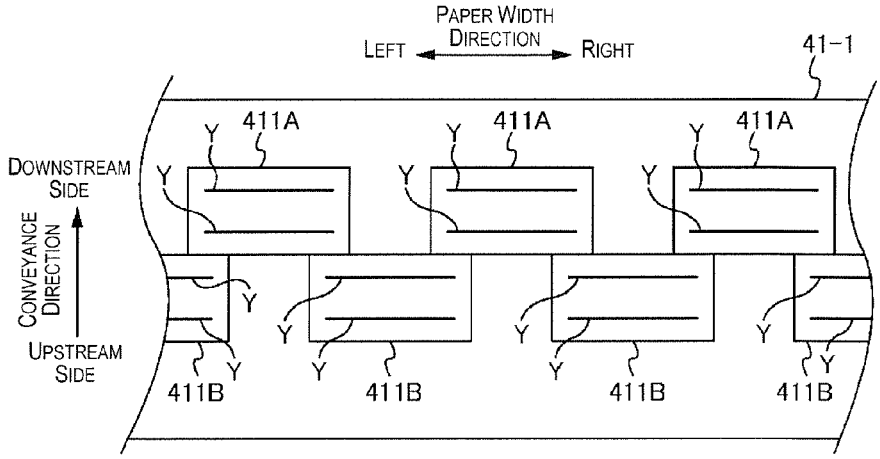
FIG. 4A is a view showing the head arrangement in the first yellow head unit 41-1.
Figure 4B:
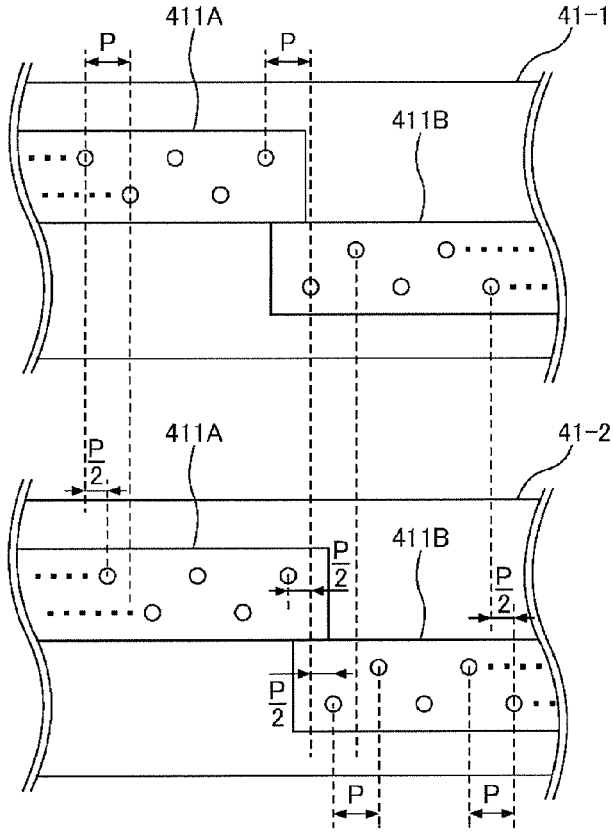
FIG. 4B is a view showing the nozzle arrangement in the first yellow head unit 41-1 and the second yellow head unit 41-2.

FIG. 4A is a view showing the head arrangement in the first yellow head unit 41-1. FIG. 4B is a view showing the nozzle arrangement in the first yellow head unit 41-1 and the second yellow head unit 41-2. FIG. 4A shows a downstream head 411A and upstream head 411B included in the first yellow head unit 41-1. The downstream head 411A and the upstream head 411B each have substantially the same configuration. These heads each have two nozzle rows.

FIG. 4B shows the nozzle pitch P of the downstream head 411A and the nozzle pitch P of the upstream head 411B. The nozzle pitch P formed by each of the two nozzle rows is 300 dpi in the present embodiment. The nozzle pitch formed by the nozzles of the first yellow head unit 41-1 and the nozzles of the second yellow head unit 41-2 is P/2, which is 600 dpi. Specifically, the printer 1 of the present embodiment is capable of printing at a maximum resolution of 600 dpi in the paper width direction.

The nozzle pitch is described above using the first yellow head unit 41-1 and the second yellow head unit 41-2 as examples, but same nozzle pitch is used in the first magenta head unit 41-3 and the second magenta head unit 41-4 as well. The same nozzle pitch is also used in the first cyan head unit 41-5 and the second cyan head unit 41-6. The same nozzle pitch is also used in the first black head unit 41-7 and the second black head unit 41-8. The same nozzle pitch is also used in the first clear ink head unit 41-9 and the second clear ink head unit 41-10.

Figure 5A:
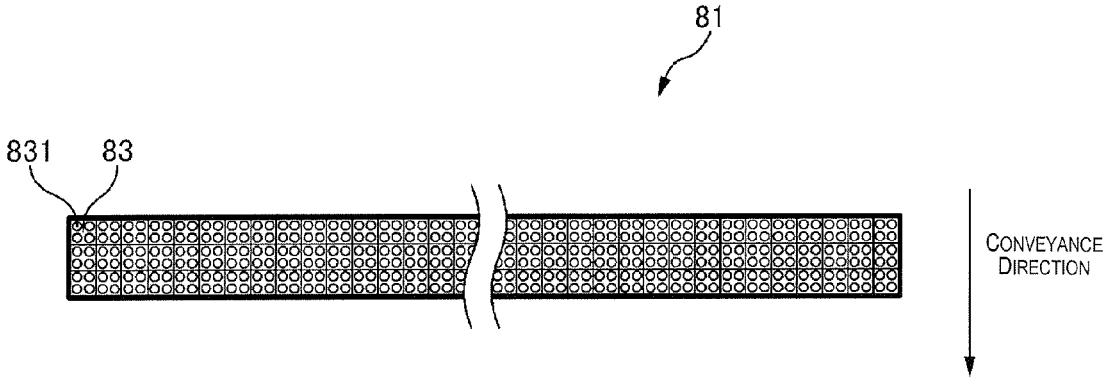
FIG. 5A is a view showing the LED assembly unit 81 in the partial-curing unit 80.

FIG. 5A is a view showing the LED assembly units 81 in the partial-curing unit 80. The partial-curing unit 80 includes ten sets of LED assembly units 81-1 through 81-10. Nine of the LED assembly units 81 have the same configuration to reduce manufacturing cost.

The LED assembly units 81 are composed of a plurality of LEDs 831. An illumination area wider than the width of the printed medium is thereby provided. The LEDs 831 used in the present embodiment have a peak wavelength of 385 to 405 nm. The supplied current is adjusted to give a pinning energy (partial curing energy) of 2 to 20 mJ/cm$^2$ in the present embodiment.

Figure 5B:
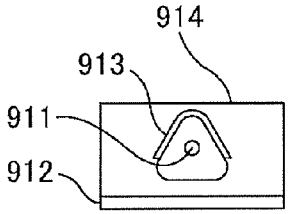
FIG. 5B is a side view showing the full-curing light source unit 91.

FIG. 5B is a side view showing the full-curing light source unit 91. The full-curing light source unit 91 is provided with a metal halide lamp 911 which forms the light source part, and a protective glass 912, a reflecting mirror 913, and a light-source-side case 914.

The metal halide lamp 911 radiates light for fully curing the ink deposited on the medium. The light radiated by the metal halide lamp 911 used in the present embodiment includes a large ultraviolet component, and cures ultraviolet-curing ink. The reflecting mirror 913 reflects the light radiated from the metal halide lamp 911 toward the medium, and the light from the metal halide lamp 911 is thereby efficiently radiated to the medium. The protective glass 912 prevents entry of debris from the passage of the medium while passing the light from the metal halide lamp 911 to the medium. The light-source-side case 914 is a case for attaching the metal halide lamp 911, the protective glass, and the reflecting mirror 913. Through use of such a full-curing light source unit 91, ink that is partially cured or not partially cured can be fully cured on the medium.

In the present embodiment, a plurality of such metal halide lamps 911 is provided in the width direction of the medium, and ultraviolet rays can be radiated to the entire surface of the conveyed medium.

Figure 6:
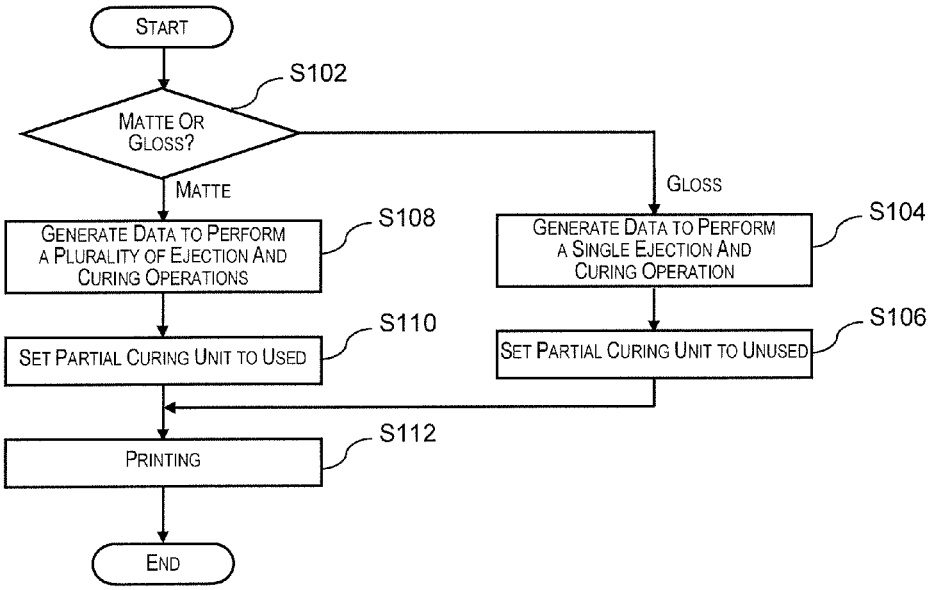
FIG. 6 is a flowchart showing the process of the printing method in a comparative example.

FIG. 6 is a flowchart showing the process of the printing method in a comparative example. The printing method according to a comparative example will first be described with reference to the flowchart of FIG. 6.

First, a determination is made as to whether to print an image as a matte image or a glossy image (S102). Here, whether to print an image as matte or glossy is set in advance by a user via a printer driver.

Here, in the case that glossy printing is selected, the printer driver generates printing data for transmission to the printer 1 so that an image is formed by a single (one) ejection and curing operation. The ejection and curing operation is an operation whereby ink is ejected, and ultraviolet rays are subsequently radiated to cure the ink on the medium. In other words, one ejection and curing operation is completed at the stage at which at least one (or more than one) ink ejection is performed and ultraviolet rays are subsequently radiated. In the case that glossy printing is selected, the partial-curing device is not used, and the ink on the medium is cured solely by the full-curing device, as described hereinafter. Consequently, printing data are generated whereby an image is formed by appropriate use of the heads of the printer 1.

The partial-curing unit is then set to "unused" (S108). Printing is then performed (S112). By thus printing without using the partial-curing unit, after the color ink and the clear ink have been ejected, all the ink is cured at once by the full-curing unit. The plurality of colors of color ink and the clear ink adjacent to each other on the medium thus integrate by surface tension, and are then cured. It is therefore possible to provide a glossy printed matter having a high degree of gloss such as described hereinafter.

In the case that matte printing is selected, the printer driver generates printing data for transmission to the printer 1 so that an image is formed by a plurality of ejection and curing operations. In the printing data for forming an image by a plurality of ejection and curing operations, a plurality of heads including an upstream head and a downstream head for at least one color of ink are tasked with ejection ink, for example. In ejection of yellow ink, for example, the printing data are configured so that the first yellow head unit 41-1 and the second yellow head unit 41-2 contribute to ejecting yellow ink.

The partial-curing unit is then set to "used" (S110). Printing is then performed (S112). Through this configuration, after the ink ejected by the upstream head is partially cured, the downstream ink is ejected and partially cured. For example, the yellow ink ejected from the first yellow head unit 41-1 is partially cured by the LED assembly unit 81-1 (which corresponds to the first partial-curing photo-irradiation device), after which the yellow ink ejected from the second yellow head unit 41-2 is partially cured by the LED assembly unit 81-2 (which corresponds to the second partial-curing photo-irradiation device).

Through this configuration, unlike the glossy printing described above, ink deposits are partially cured before integrating due to surface tension, and it is possible to provide a matte printed matter having a low degree of gloss such as described hereinafter.

Figure 7:
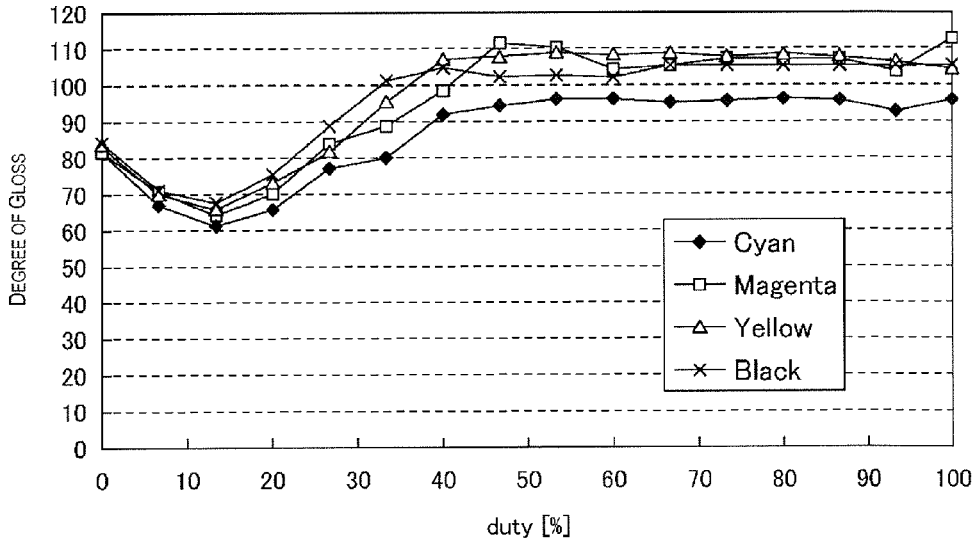
FIG. 7 is a first view showing the relationship between the pass count and the degree of gloss in a comparative example.

FIG. 7 is a first view showing the relationship between the pass count and the degree of gloss in a comparative example. FIG. 7 shows the degree of gloss in a case in which glossy printing is performed by the printing procedure described above. In FIG. 7, the horizontal axis shows the duty (print duty), and the vertical axis shows the degree of gloss. The term "duty" here refers to the amount of ink applied for a pixel. Here, a duty of 100% indicates that all pixels are filled with a single color of ink. The degree of gloss is obtained using a Handy Gloss Meter PG-1M manufactured by Nippon Denshoku Industries Co., Ltd. In the present embodiment, degree of gloss was measured at a single angle of 60°.

As a result, the degree of gloss is high when the duty is 30% to 100%, whereas the degree of gloss is somewhat low when the duty is 0% to 30% (low-duty side).

Figure 8:
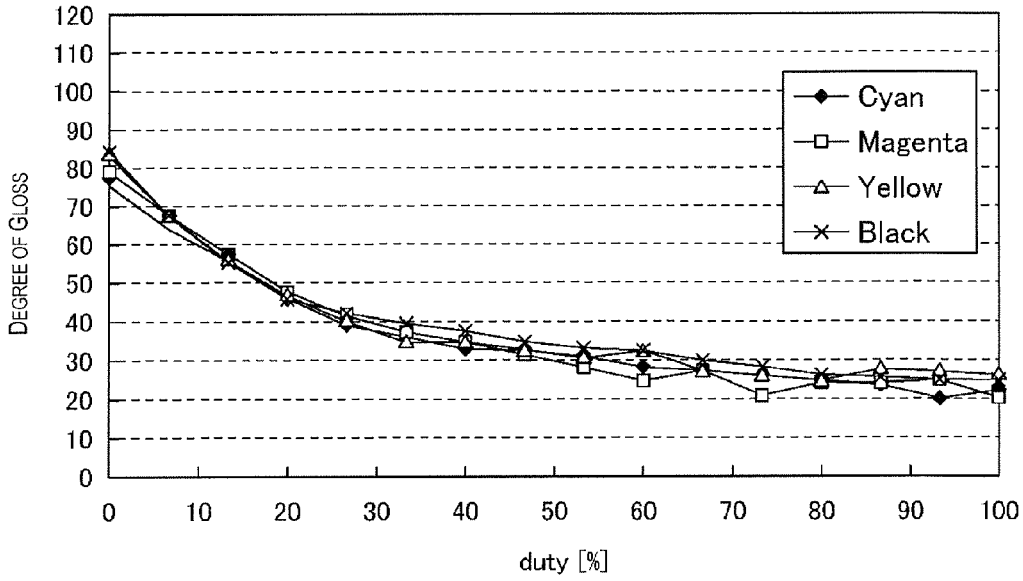
FIG. 8 is a second view showing the relationship between the pass count and the degree of gloss in a comparative example.

FIG. 8 is a second view showing the relationship between the pass count and the degree of gloss in a comparative example. FIG. 8 shows the degree of gloss in a case in which matte printing is performed by the printing procedure described above. As a result, the degree of gloss is low when the duty is 30% to 100%, whereas the degree of gloss has a somewhat high value when the duty is 0 to 30% (low-duty side).

Figure 9:
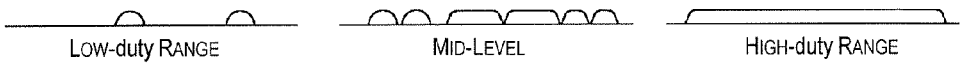
FIG. 9 is a view showing the ink shape of glossy printing in a comparative example.
Figure 10:
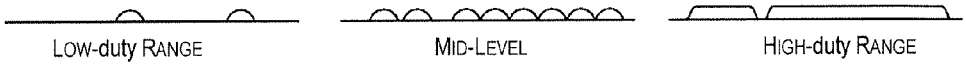
FIG. 10 is a view showing the ink shape of matte printing in a comparative example.

FIG. 9 is a view showing the ink shape of glossy printing in a comparative example. FIG. 10 is a view showing the ink shape of matte printing in a comparative example. FIGS. 9 and 10 will be compared. In the low-duty range, since the ejected quantity of ink droplets is small, ink on the medium does not come in contact with adjacent ink, and the ink is cured by ultraviolet rays while maintaining a hemispherical shape.

In the mid-level region of FIG. 9 (showing the results of glossy printing), a case is added in which the ink ejected by the upstream head (head unit) and the ink ejected by the downstream head (head unit) are adjacent to each other on the medium. When adjacent ink deposits touch each other, surface tension causes the ink deposits to integrate on the medium. Since the ink deposits are cured by the full-curing unit 90 after integrating in this manner, the ratio of ink having a flattened surface increases, and as a result, the ratio of diffusely reflected light decreases, and the printed matter then appears to have a high degree of gloss in mid-level regions.

FIG. 10 (showing the results of matte printing) adds a case in which the ink ejected by the upstream head (head unit) and the ink ejected by the downstream head (head unit) are adjacent to each other on the medium in the mid-level region as well. However, in matte printing in a comparative example, each time that ink ejected by the upstream head (head unit) is deposited on the medium, the ink is partially cured by the partial-curing unit. Each time that ink ejected by the downstream head (head unit) is deposited on the medium, the ink is also partially cured by the partial-curing unit. Both of these inks thus maintain a hemispherical shape without integrating on the medium. When ink deposits cured in this manner are arranged on the medium, light is diffusely reflected by the hemispherical ink deposits, and as a result, the printed matter appears to have a low degree of gloss. In the low-duty range, however, the higher degree of gloss than the mid-level and high-duty ranges can be due to the effect of the degree of gloss of the medium, since the ejected quantity of color ink is small.

The difference between FIGS. 9 and 10 is more apparent in the high-duty ranges thereof. Specifically, since the quantity of ejected ink increases, adjacent ink deposits integrate more readily when partial curing is not performed. When partial curing is performed, the ratio of ink that diffusely reflects light increases. Consequently, there is more of a decrease in the degree of gloss in the high-duty range when matte printing is performed.

The degree of gloss in the low-duty range is thus lower than the degree of gloss in the mid-level and high-duty ranges in the case of glossy printing. However, in glossy printing, there is a need to increase the degree of gloss in the low-duty range and provide a printed matter having a uniformly high degree of gloss in the entire image. In the case of matte printing, the degree of gloss in the low-duty range is higher than the degree of gloss in the mid-level and high-duty ranges. However, in matte printing, there is a need to reduce the degree of gloss in the low-duty range and provide a printed matter having a uniformly low degree of gloss in the entire image. These problems are overcome as described below.

Figure 11:
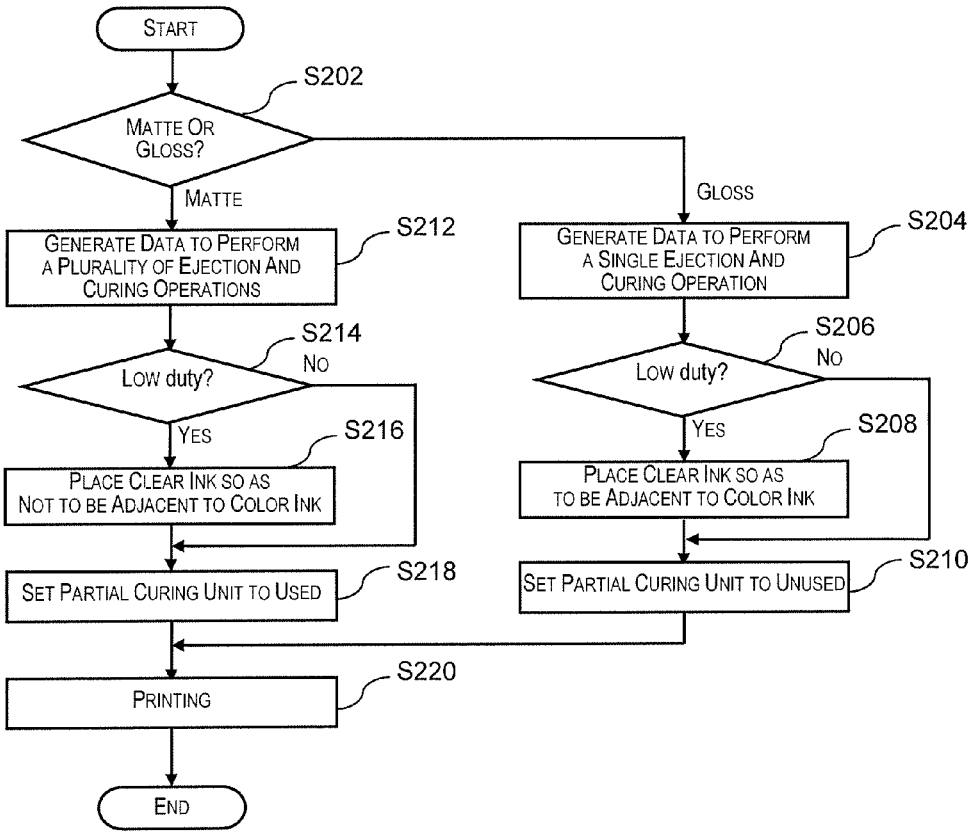
FIG. 11 is a flowchart showing the process of the printing method in the first embodiment.

FIG. 11 is a flowchart showing the process of the printing method in the first embodiment. The printing method of the first embodiment differs from the comparative example described above in that processing is added for steps S206, S208, S214, and S216.

First, a determination is made as to whether to print an image as a matte image or a glossy image (S202). This processing is the same as that of step S102 of the comparative example.

Here, in the case that glossy printing is selected, the printer driver generates printing data for transmission to the printer 1 so that an image is formed by a single ejection and curing operation (S204). This processing is the same as that of step S104 of the comparative example.

A determination is then made as to whether the ejection quantity of color ink per unit area is less than a predetermined quantity for each predetermined region of the image formed (S206). Image data for clear ink are then generated so that clear ink is placed adjacent to the color ink for regions (i.e., low-duty regions) in which the ejection quantity of color ink per unit area is less than the predetermined quantity (S208).

Figure 12A:
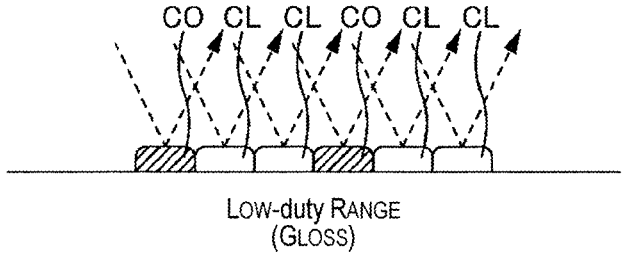
FIG. 12A is a view showing the ink placement and ink shape of glossy printing in the first embodiment.

FIG. 12A is a view showing the ink placement and ink shape of glossy printing in the first embodiment. In FIG. 12A, deposited color ink is indicated by the reference symbol CO, and deposited clear ink is indicated by the reference symbol CL. When the clear ink is placed adjacent to the color ink, the adjacent color ink and clear ink partially integrate with each other due to surface tension. A printed matter having a high degree of gloss can then be provided by using the full-curing device to cure all of the ink. Even when the color ink and the clear ink are integrated with each other, since the ink is immediately cured by the full-curing device immediately following, no change in hue occurs.

The partial-curing unit is then set to "unused" (S210). Printing is then performed (S220). By thus printing without using the partial-curing unit, after the color ink and the clear ink have been ejected, all the ink is cured at once by the full-curing unit. The plurality of colors of color ink and the clear ink adjacent to each other on the medium thus integrate by surface tension, and are then cured. It is therefore possible to provide a glossy printed matter having a high degree of gloss.

In the case that matte printing is selected, the printer driver generates printing data for transmission to the printer 1 so that an image is formed by a plurality of ejection and curing operations (S212). This processing is the same as that of step S108 of the comparative example.

A determination is then made as to whether the ejection quantity of color ink per unit area is less than a predetermined quantity for each predetermined region of the image formed (S214). Image data for clear ink are then generated so that clear ink is placed not adjacent to the color ink for regions (i.e., low-duty regions) in which the ejection quantity of color ink per unit area is less than the predetermined quantity (S218).

Figure 12B:
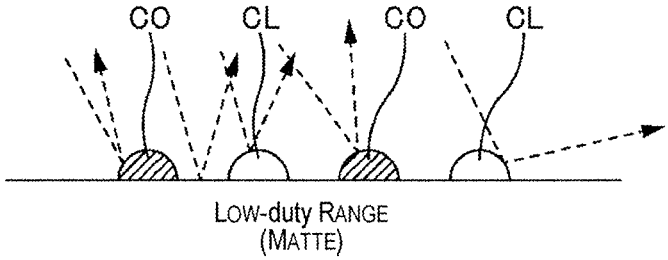
FIG. 12B is a view showing the ink placement and ink shape of matte printing in the first embodiment.

FIG. 12B is a view showing the ink placement and ink shape of matte printing in the first embodiment. In FIG. 12B, deposited color ink is indicated by the reference symbol CO, and deposited clear ink is indicated by the reference symbol CL. When the clear ink is thus placed so as not to be adjacent to the color ink in the low-duty range, since the color ink and the clear ink are deposited in positions apart from each other, the color ink and clear ink are each cured in the subsequent partial curing. These ink deposits are thus fixed on the medium in the hemispherical shape thereof without integrating. Since the hemispherical color ink and clear ink deposits cause diffuse reflection, a printed matter having a low degree of gloss can be provided.

The partial-curing unit is then set to be used (S218). Printing is then performed (S220). By thus printing with the use of the partial-curing unit, the color ink and clear ink ejected and deposited on the medium can be individually cured. The plurality of colors of color ink and the clear ink adjacent to each other on the medium thus cause diffuse reflection and do not integrate by surface tension, and a matte printed matter having a low degree of gloss can be provided.

By printing according to the first embodiment, in glossy printing, the surface can be intentionally smoothed in the low-duty range of the color ink, and a printed matter can be provided that has a high degree of gloss in the entire density range. In matte printing, the surface can be intentionally roughened in the low-duty range of the color ink, and a printed matter can be provided that has a low degree of gloss in the entire density range.

The degree of gloss of an image can also be adjusted by dividing printing into cases in which an image is formed by only a single ejection and curing operation for ejecting ink and subsequently radiating ultraviolet rays to cure the ink, and cases in which an image is formed by performing multiple ejection and curing operations. Here, glossy printing is described as being performed by a single ejection and curing operation, but this number of ejection and curing operations is not limited to one insofar as the number is less than the number of ejection and curing operations that is performed during matte printing.

Second Embodiment

Figure 13:
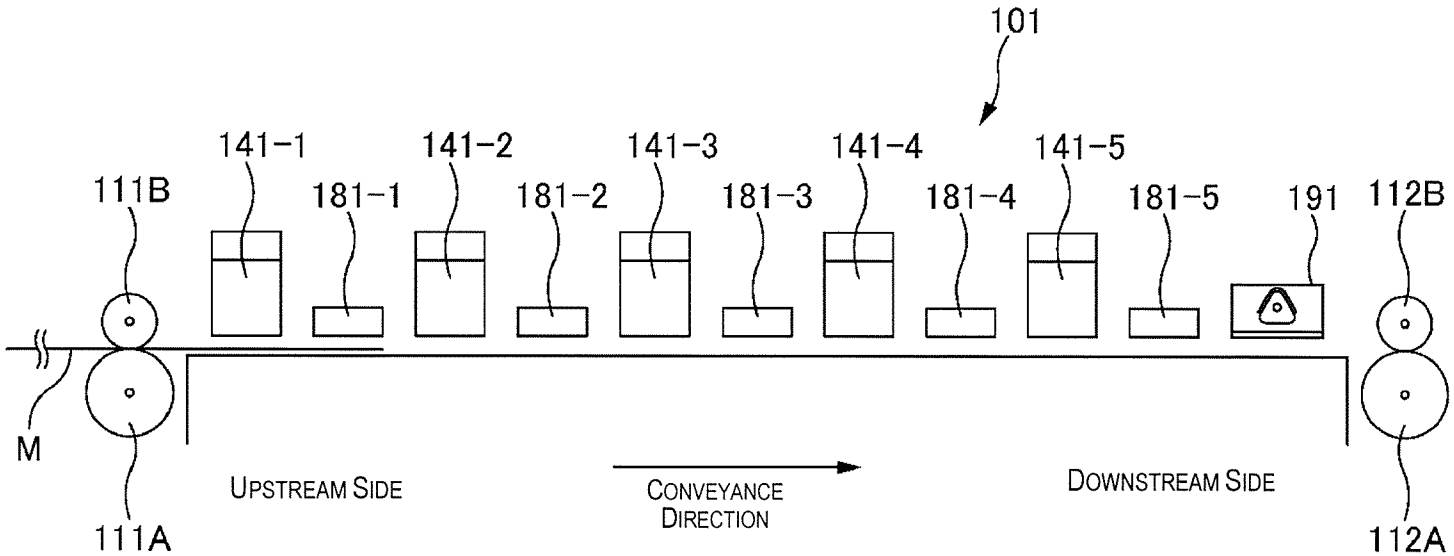
FIG. 13 is a rough side view showing the printer 1 in a second embodiment.
Figure 14:
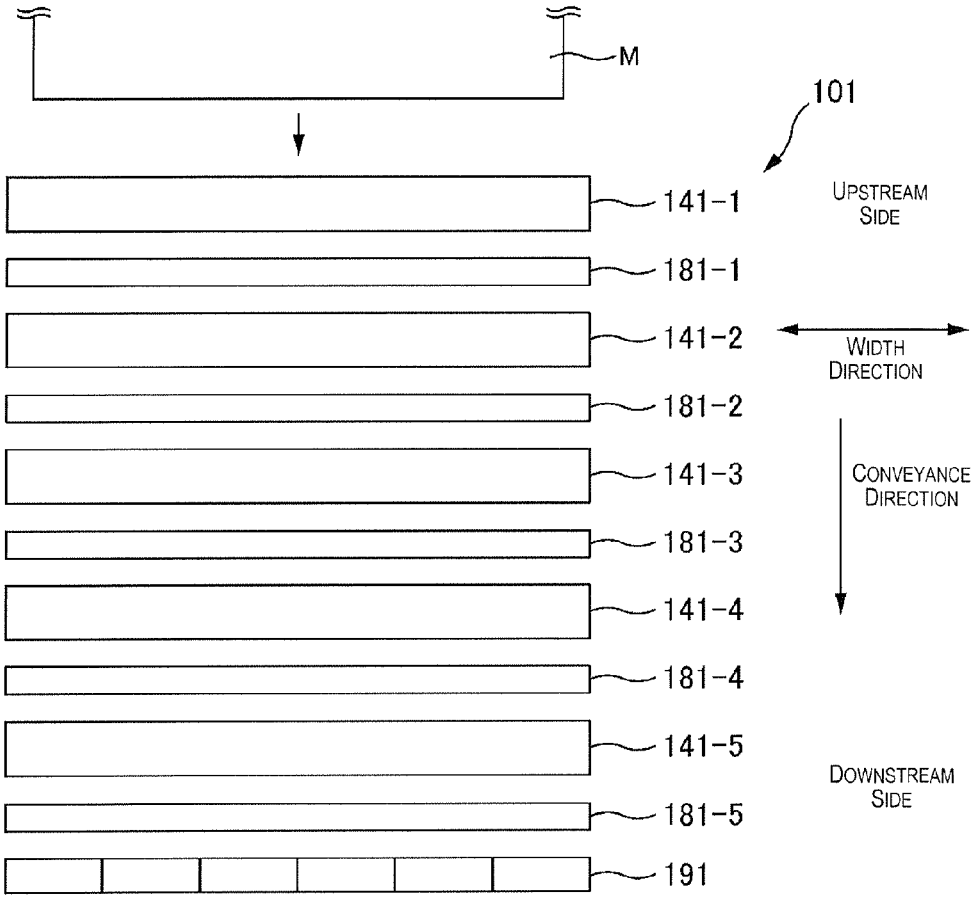
FIG. 14 is a rough top view showing the printer 1 in the second embodiment.

FIG. 13 is a rough side view showing the printer 1 in a second embodiment. FIG. 14 is a rough top view showing the printer 1 in the second embodiment. The configuration of components of the second embodiment other than the head unit 40 in the first embodiment is substantially the same as in the first embodiment. Reference numerals for the second embodiment are obtained by adding 100 to the reference numerals for the first embodiment, and components that are the same as in the first embodiment will not be described. The configuration of the head unit that differs from the first embodiment will be described.

The second embodiment differs from the first embodiment with respect to the order of inks ejected by the heads of the head units. In the second embodiment, a head unit 141-1 ejects yellow ink and magenta ink. A head unit 141-3 also ejects yellow ink and magenta ink. A head unit 141-2 ejects cyan ink and black ink. A head unit 141-4 also ejects cyan ink and black ink. A head unit 141-5 ejects clear ink only.

Figure 15A:
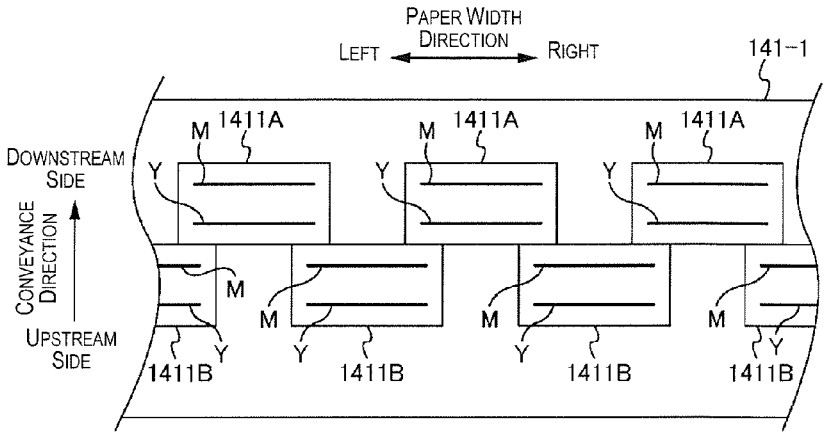
FIG. 15 is a view showing the head arrangement in the head unit of the second embodiment.
Figure 15B:
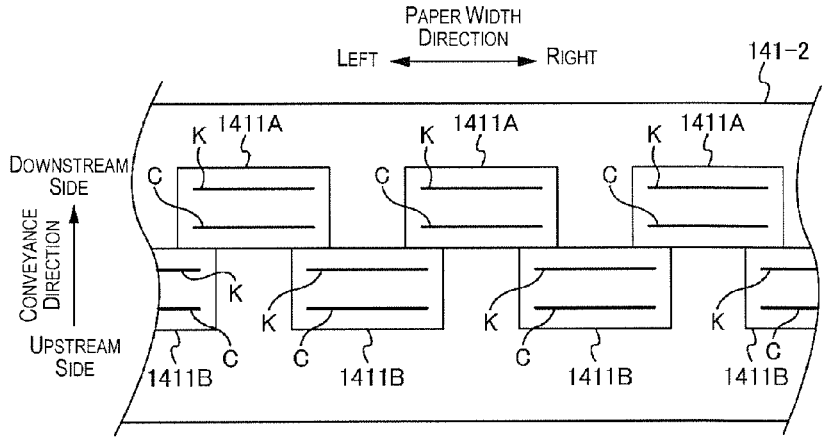
Figure 15C:
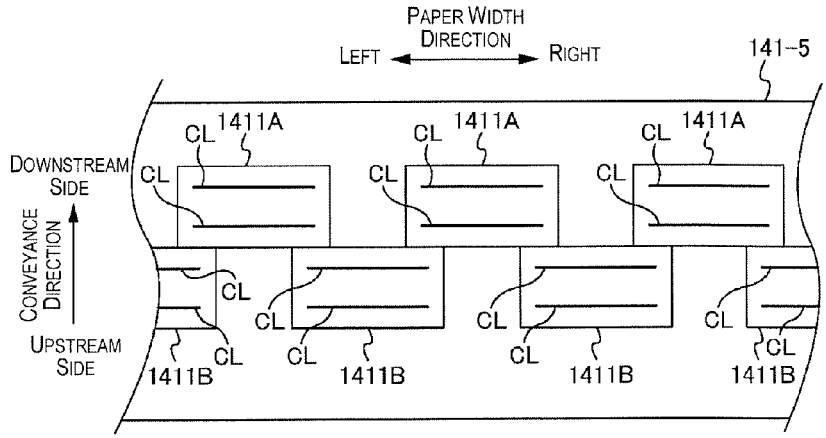

FIG. 15 is a view showing the head arrangement in the head units of the second embodiment. In FIG. 15, the nozzle rows on the upstream side in upstream heads 1411B of the head unit 141-1 eject yellow ink, and the nozzle rows on the downstream side thereof eject magenta ink. The nozzle configuration of downstream heads 1411A is the same as in the upstream heads 1411B in this case as well. The head unit 141-3 as a head unit downstream from the head unit 141-1 has substantially the same configuration as the head unit 141-1, but the positions of the nozzles are offset the distance P/2 in the paper width direction with respect to the nozzles of the head unit 141-1. Printing by the nozzles of the head unit 141-1 and the nozzles of the head unit 141-3 can thereby be performed at a resolution of 600 dpi in the paper width direction.

In the heads of the head unit 141-2, the nozzle rows on the upstream side eject cyan ink and the nozzle rows on the downstream side eject black ink. The heads of the head unit 141-4 also have substantially the same configuration, but in this case as well, the positions of the nozzles are offset the distance P/2 in the paper width direction with respect to the nozzles of the head unit 141-2, and printing can thereby be performed at a resolution of 600 dpi in the paper width direction. All of the nozzle rows of the head unit 141-5 eject clear ink.

In this configuration as well, in the case of matte printing, through use of the LED assembly units, the first yellow ink ejection is performed by the head unit 141-1 and subsequently partially cured by an LED assembly unit 181-1, and the second yellow ink is performed by the head unit 141-3 and subsequently partially cured by an LED assembly unit 181-3, for example. Through this configuration, adjacent yellow ink deposits are partially cured before integrating due to surface tension, and it is possible to provide a matte printed matter having a low degree of gloss.

On the other hand, in a configuration in which the LED assembly units are not used in the case of glossy printing, yellow ink is ejected by the head unit 141-1, and yellow ink is ejected by the head unit 141-3. Adjacent yellow ink deposits then integrate due to surface tension. These ink deposits are then cured by the main curing unit 90 (main curing light source unit 91), and a printed matter having a high degree of gloss can therefore be provided.

Adopting a head configuration such as that of the second embodiment makes it possible to have a smaller number of head units and LED assembly units than by the first embodiment.

Other Embodiments

The printer 1 is described as a liquid ejection device in the above embodiments. However, the liquid ejection device is not limited to a printer, and the liquid ejection device can also eject or discharge a fluid (liquid, liquid body in which particles of a functional material are dispersed, or a fluid such as a gel) other than ink. For example, the same techniques as those of the embodiments described above can be applied to various types of devices which utilize an inkjet technique, such as color filter manufacturing devices, dyeing devices, micro-fabrication devices, semiconductor manufacturing devices, surface processing devices, three-dimensional modeling devices, vaporization devices, organic EL manufacturing devices (particularly polymer EL manufacturing devices), display manufacturing devices, film formation devices, and DNA chip manufacturing devices. These methods and manufacturing methods are also within the range of application of the invention.

The embodiments described above are intended to facilitate understanding of the invention and shall not be construed as limiting the invention. The invention can be modified or improved within the intended scope thereof, and it shall be apparent that the invention encompasses equivalents thereto.

<Heads>

In the embodiments described above, piezoelectric elements are used to discharge ink. However, the scheme whereby liquid is discharged is not thus limited. For example, a scheme whereby bubbles are generated in the nozzles by heat, or another scheme can also be used.

What is claimed is:

1. A printing device comprising:

a color ink head configured to eject color ink to a medium;

a clear ink head configured to eject transparent clear ink to the medium; and a controller configured to control ejection of the clear ink so that the clear ink is ejected to a region in which an ejection quantity of the color ink per unit area of the medium is less than a predetermined quantity, and the clear ink is not ejected to a region in which the ejection quantity of the color ink per unit area of the medium is greater than the predetermined quantity, the controller controlling the clear ink head to eject the clear ink so as to be adjacent to the color ink, when an image having a first degree of gloss is formed, and controlling the clear ink head to eject the clear ink so as not to be adjacent to the color ink, when an image having a second degree of gloss lower than the first degree of gloss is formed.

2. The printing device according to claim 1, wherein the color ink is a photo-curing color ink;

the clear ink is a photo-curing clear ink; and a photo-irradiation device is further provided for radiating light to the medium to cure at least one of the photo-curing color ink and the photo-curing clear ink.

3. The printing device according to claim 2, wherein the controller performs an ejection and curing operation for ejecting the photo-curing color ink and subsequently radiating the light to the medium to cure the photo-curing color ink, when an image having the first degree of gloss is formed, the image is formed by a first number of ejection and curing operations, and when an image having the second degree of gloss is formed, the image is formed by a second number of ejection and curing operations greater than the first number.

4. The printing device according to claim 3, wherein the controller radiates light to the medium after causing the photo-curing clear ink to be ejected so as to be adjacent to the photo-curing color ink in a case in which the ejection quantity of the photo-curing color ink per unit area of the medium is less than the predetermined quantity, when an image having the first degree of gloss is formed; and the controller radiates the light after causing the photo-curing clear ink to be ejected so as not to be adjacent to the photo-curing color ink in a case in which the ejection quantity of the photo-curing color ink per unit area of the medium is less than the predetermined quantity, when an image having the second degree of gloss is formed.

5. The printing device according to claim 4, wherein the photo-irradiation device includes at least a color ink partial-curing device and a clear ink partial-curing device; and during formation of the image having the second degree of gloss, the photo-curing color ink is partially cured by the color ink partial-curing device after the photo-curing color ink is ejected from the color ink head, and the photo-curing clear ink is partially cured by the clear ink partial-curing device after the photo-curing clear ink is ejected from the clear ink head.

6. The printing device according to claim 5, wherein the photo-irradiation device further includes a full-curing photo-irradiation device; and during formation of the image having the first degree of gloss, the photo-curing color ink is ejected from the color ink head, and the photo-curing clear ink is ejected from the clear ink head, and thereafter the photo-curing color ink and the photo-curing clear ink are cured by the full-curing photo-irradiation device.

7. The printing device according to claim 3, wherein the first number is one.

8. The printing device according to claim 1, wherein the photo-irradiation device includes a partial-curing device and a full-curing photo-irradiation device, during formation of the image having the first degree of gloss, the partial-curing device is not used and the full-curing photo-irradiation device is used, and during formation of the image having the second degree of gloss, the partial-curing device and the full-curing photo-irradiation device are used.

9. A printing method comprising:

calculating an ejection quantity of color ink for each predetermined unit area of a medium;

ejecting clear ink only to a region in which the ejection quantity of the color ink per the unit area in the medium is less than a predetermined quantity, the ejecting of the clear ink including ejecting the clear ink so as to be adjacent to the color ink, when an image having a first degree of gloss is formed, and ejecting the clear ink so as not to be adjacent to the color ink, when an image having a second degree of gloss lower than the first degree of gloss is formed.

* * * * *